US005419260A

United States Patent [19]

Hamilton

[11] Patent Number: 5,419,260

[45] Date of Patent: May 30, 1995

[54] SELF-PROPELLED OVERHEAD TRACK-MOUNTED MOVING SYSTEM

[76] Inventor: James Hamilton, 30670 Moffat Ave., Steamboat Springs, Colo. 80487

[21] Appl. No.: 168,085

[22] Filed: Dec. 15, 1993

[51] Int. Cl.[6] ..... B61B 3/02

[52] U.S. Cl. ..... 104/89; 104/95; 105/30; 105/153; 105/155

[58] Field of Search ..... 104/89, 93–95, 104/106, 107, 109, 250, 303; 105/30, 148, 150, 153–155

[56] References Cited

U.S. PATENT DOCUMENTS

| | | | |
|---|---|---|---|
| 1,614,842 | 1/1927 | Kruckenberg et al. | 104/89 |
| 2,593,941 | 4/1952 | Van Sciver | 104/303 |
| 2,858,381 | 10/1958 | Goldberg et al. | 191/12 |
| 2,961,797 | 11/1960 | Bonanno | 104/303 |
| 3,016,024 | 1/1962 | Silver | 104/303 |
| 3,074,354 | 1/1963 | Wakkila | 104/93 |
| 3,129,671 | 4/1964 | Vanderbeck | 104/93 |
| 3,212,455 | 10/1965 | Workman | 104/89 |
| 3,263,626 | 8/1966 | Henderson | 104/93 |
| 3,495,720 | 2/1970 | Mann, Jr. et al. | 104/89 |
| 4,316,238 | 2/1982 | Booty et al. | 362/147 |
| 4,441,145 | 4/1984 | Antkowiak | 362/384 |
| 4,734,830 | 3/1988 | Cristian et al. | 362/35 |

OTHER PUBLICATIONS

The Ultimate Linear Lamp Mover (Light Rail II).

*Primary Examiner*—Robert J. Oberleitner
*Assistant Examiner*—Linh Do
*Attorney, Agent, or Firm*—John R. Flanagan

[57] ABSTRACT

A self-propelled overhead track-mounted moving system includes an elongated support rail attachable to an overhead support structure, a carrier trolley mounted for undergoing movement along the support rail, an actuation unit supported on the support rail and on one side of the trolley, and a drive unit mounted on an opposite side of the trolley and coupled to the actuation unit. The support rail has a pair of top guide tracks and a bottom guide track. The trolley includes a housing having a pair of opposite lateral sides and a pair of front and rear ends. The trolley also includes front and rear pairs of roller wheels rotatably mounted to front and rear ends of an upper portion of the housing and supported upon the top guide tracks of the support rail and an object hanger attached to a lower portion of the housing and being disposed in a substantially centered position on the housing between the front and rear pairs of roller wheels to provide a substantially uniform distribution of the weight of a suspended object over all of the wheels. The drive unit includes a power source and a drive wheel coupled therewith and engaged with the bottom guide track of the support rail for drivingly causing movement of the carrier trolley therealong upon operation of the drive unit by the actuation unit.

13 Claims, 2 Drawing Sheets

2
20
12
10
20A
24
28
46
22
22A
50
52
26
36
38
16
56
58
38A
34
38B
36A
80
18
14
42
36B

MOTOR
56
90
88
A
B
84A
- +

4
30
C
20
12
20A
16
28
14
44
82
50
10
46
48
86
24
22
22A
52
18
80
68
36A
26
60
72
58
54
34
56
4
80B
38
38A
36
68
38B
40
90
42
36B
TO
120VAC

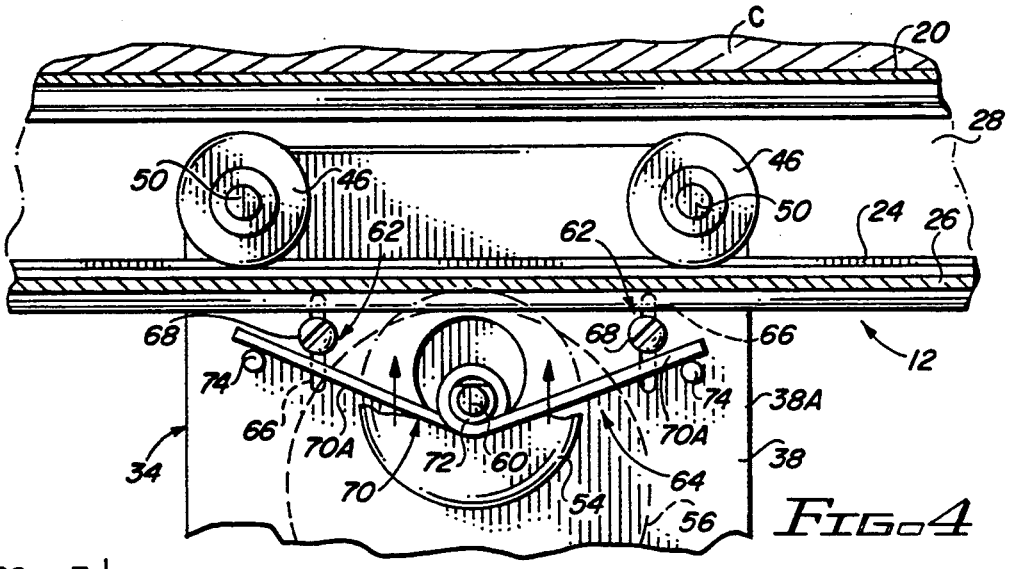
FIG. 4
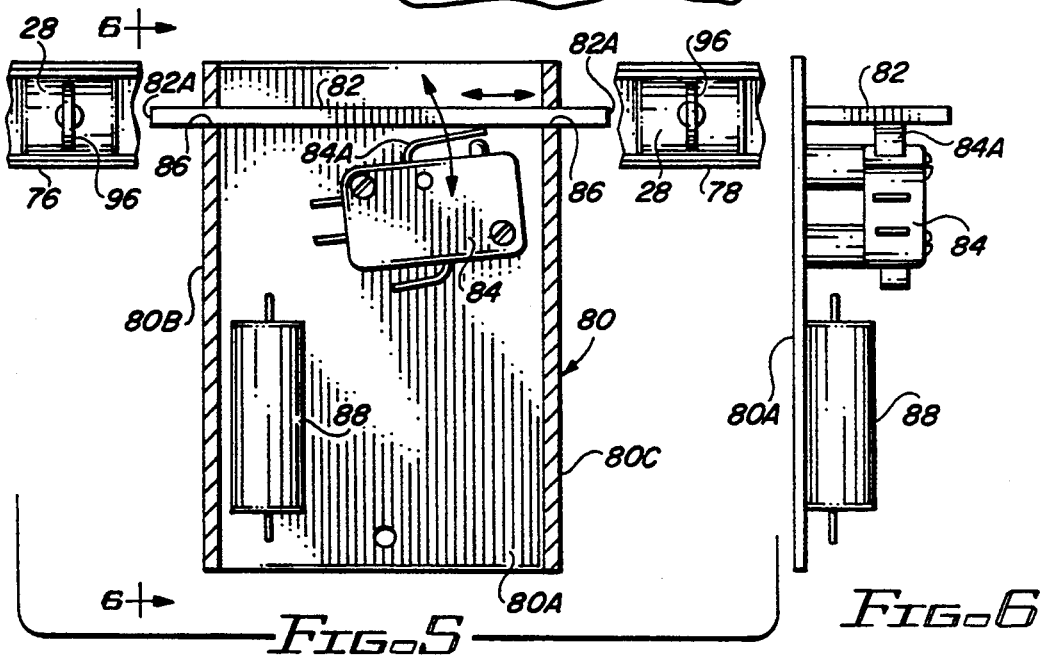
FIG. 5
FIG. 6
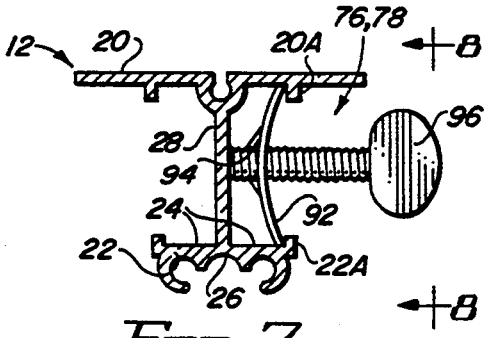
FIG. 7
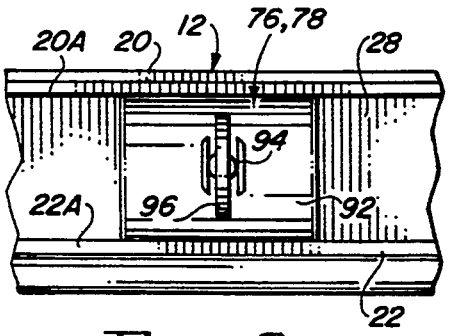
FIG. 8

SELF-PROPELLED OVERHEAD TRACK-MOUNTED MOVING SYSTEM

BACKGROUND OF THE INVENTION

1. Field of the Invention

The present invention generally relates to an overhead linear moving system and, more particularly, is concerned with an improved self-propelled overhead track-mounted moving system.

2. Description of the Prior Art

Greenhouses and indoor grow rooms typically receive insufficient natural light, that is, sunlight. This deficiency of sunlight is remedied by using artificial light exclusively or to supplement the sunlight. A variety of different systems have been proposed in the prior patent art to provide artificial light to indoor plants. Some of these systems are represented by the devices and fixtures disclosed in U.S. patents to Goldberg et al U.S. Pat. No. 2,858,381, Booty et al U.S. Pat. No. 4,316,238, Antkowiak U.S. Pat. No. 4,441,145 and Cristian et al U.S. Pat. No. 4,734,830.

Another more advanced system, known as the Light Rail II, has been marketed by the inventor herein. The prior system is an overhead linear moving system which included an elongated track or rail having a W-shaped cross-sectional configuration defining opposite top and bottom guide grooves and a light suspending trolley having support wheels running in the top guide grooves and a drive wheel engaging the bottom guide groove which is driven by a reversible motor attached to one end of the trolley. The object supported from this prior moving system is applied to the end of a bracket mounted to the opposite end of the trolley from the motor.

The aforementioned Light Rail II linear moving system has functioned as intended and resulted in many satisfied purchasers as evidence by its low return rate. However, as with all, even highly successful, products, the need arises from time to time to make improvements in certain areas to further enhance the capabilities of a product and the benefits derived therefrom by users.

SUMMARY OF THE INVENTION

The present invention provides an improved self-propelled overhead track-mounted moving system designed to satisfy the aforementioned need. The overhead moving system of the present invention provides a more equal and uniform distribution of the weight of the suspended object over all of the wheels of the trolley so as to reduce an excessive amount of wear and noise produced by the design of the prior moving system. Also, the top guide tracks now have flat configurations which increases the surface area of contact between the wheels and tracks. Further, improvements have been provided in terms of placement of the trolley housing which mounts the motor in a substantially centered position relative to the trolley wheels and a biasing mechanism being provided for enhancing traction of the drive wheel with the bottom guide track so that the motor will operate with the same load in both directions of movement and operates properly without the assistance of weight provided by the object being supported so as to apply traction to the drive wheel.

Accordingly, the present invention is directed to an overhead moving system which comprises: (a) an elongated support rail attachable to an overhead support structure; (b) a carrier trolley rotatably mounted to the support rail for undergoing movement along the support rail, the carrier trolley including a housing having a pair of opposite lateral sides and rotatable means mounted on an upper portion of the housing for movably supporting the housing from the support rail; (c) an actuation unit supported on the housing on one of the pair of lateral sides thereof; and (d) a drive unit mounted on the housing on the other of the pair of lateral sides thereof, the drive unit being coupled to the actuation unit and to the support rail for drivingly causing movement of the carrier trolley therealong upon actuation of the drive unit by the actuation unit. The support rail includes a pair of top guide tracks each having a flat configuration and a bottom guide track having a concave cross-sectional configuration.

The moving system also comprises means for mounting the drive unit on the housing to undergo slidable movement relative thereto and toward and away from the support rail and means for applying a force on the drive unit so as to bias the drive unit toward the support rail and thereby maintain traction of the drive unit with the support rail. The drive unit mounting means includes means defining a plurality of elongated slots in the other lateral side of the housing and a plurality of fasteners attached to the drive unit and extending through the slots so as to permit movement of the fasteners along and relative to the slots and thereby movement of the drive unit along and relative to the housing. The force applying means includes a yieldable flexible torsion spring member coupled between the other lateral side of the housing and the drive unit.

The actuation unit includes first and second stop means mounted in spaced locations along the support rail in opposite directions from the carrier trolley, an actuating arm mounted on the one lateral side of the housing and engagable with the first and second stop means, and a switch mechanism mounted on the one lateral side of the housing and being coupled to the actuating arm. The switch mechanism is actuatable between first and second positions so as to actuate the drive unit to move the carrier trolley in opposite directions along the support rail in response to engagement by the actuating arm with the first and second stop means.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 4 is a fragmentary side elevational view of the overhead moving system as seen along line 4—4 of FIG. 2.

FIG. 5 is an enlarged side elevational view of components of the electrical circuit of FIG. 3.

FIG. 6 is an end elevational view of the electrical components as seen along line 6—6 of FIG. 5.

FIG. 7 is an enlarged cross-sectional view of the elongated track of the overhead moving system of FIG. 1, showing a switch stop mounted therealong.

FIG. 8 is a side elevational view of the switch stop as seen along line 8—8 of FIG. 7.

DETAILED DESCRIPTION OF THE INVENTION

Figure 1:
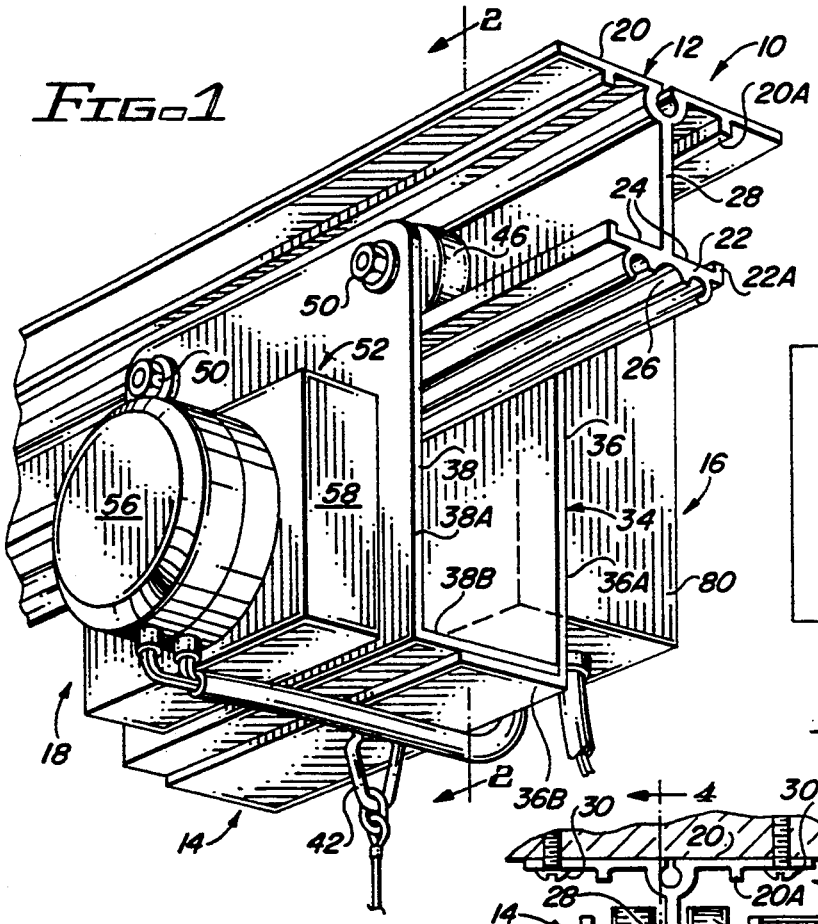
FIG. 1 is a perspective view of a self-propelled overhead track-mounted moving system of the present invention.
Figure 2:
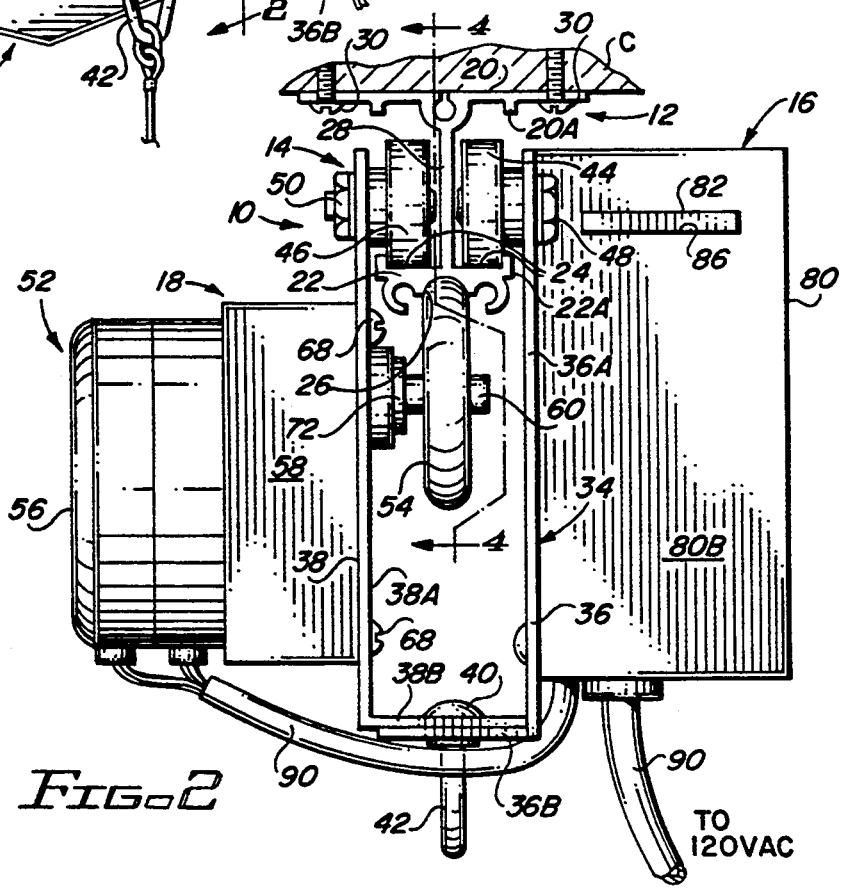
FIG. 2 is a front elevational view of the overhead moving system as seen along line 2—2 of FIG. 1.

Referring to the drawings and particularly to FIGS. 1 and 2, there is illustrated a self-propelled overhead moving system, generally designated 10, of the present invention. Basically, the overhead moving system 10 includes an elongated support rail 12 attachable to an overhead support structure, such as a ceiling C, a carrier trolley 14 mounted to the support rail 12 for undergoing movement therealong, an actuation unit 16 mounted on the support rail 12 and also supported on the carrier trolley 14, and a drive unit 18 coupled to the actuation unit 16 and to the support rail 12 for drivingly causing movement of the carrier trolley 14 therealong upon actuation of the drive unit 18 by the actuation unit 16.

Referring to FIGS. 1, 2, 4, 7 and 8, the elongated support rail 12 of the overhead moving system 10 includes an upper mounting base 20, a lower member 22 having a pair of top guide tracks 24 and a bottom guide track 26 defined thereon, and a vertical support member 28 extending between the upper mounting base 20 and lower member 22. The top guide tracks 24 each have flat configurations while the bottom guide track 26 has a concave cross-sectional configuration. The vertical support member 28 are connected along an upper edge to the upper mounting base 20 and along a lower edge to the lower member 22 between the pair of top guide tracks 24. The upper mounting base 20 is adapted to be attached to the overhead support structure C, such as a ceiling, by a plurality of screws 30 installed through holes 32 defined in the upper mounting base 20 on opposite sides of the vertical support member 28. The elongated support rail 12 can be made of any suitable material, such as aluminum.

Referring to FIGS. 1, 2 and 4, the carrier trolley 14 of the overhead moving system 10 includes a housing 34 formed of a pair of right and left L-shaped plate-like members 36, 38 to provide a pair of spaced sidewalls 36A, 38A and a pair of superimposed bottom walls 36B, 38B. The bottom walls 36B, 38B are attached together by a fastener 40 which also has an object hanger 42 connected thereto below the bottom walls 36B, 38B. The carrier trolley 14 also includes right and left pairs of roller wheels 44, 46 which are mounted respectively by right and left pairs of spindle assemblies 48, 50 on interior sides of the sidewalls 36A, 38A of the housing 34 adjacent to front and rear ends of the housing 34. The adjacent roller wheels 44, 46 of the respective pairs thereof are laterally spaced apart from one another on opposite sides of the vertical support member 28 of the support rail 12. Also, the roller wheels 44, 46 of each pair thereof are spaced apart fore and aft along the top guide tracks 24 of the lower member 22 of the support rail 12 and are movable therealong. Further, the object hanger 42 attached to the fastener 40 is being disposed in a substantially centered position on the housing 34 between the front and rear ends thereof and between the front and rear roller wheels 44, 46 of the pairs thereof so to provide a substantially uniform distribution of the weight of a suspended object over all of the wheels 44, 46.

Referring to FIGS. 1–4, the drive unit 18 of the overhead moving system 10 is disposed on the exterior of the sidewall 38A of the left L-shaped member 38 of the housing 34 on left lateral side thereof. The drive unit 16 includes a power source 52 and a drive wheel 54. The power source 52 is in the form of a motor 56 and a gear box 58 having a rotary output shaft 60 mounting the drive wheel 54. The drive wheel 54 is rotatably coupled to and engaged with the bottom guide track 26 on the underside of the lower member 22 of the support rail 12 for drivingly causing movement of the carriage trolley 14 therealong upon operation of the drive unit 18 by the actuation unit 16.

Also referring to FIGS. 2 and 4, the overhead moving system 10 includes means 62 for mounting the drive unit 18 on the left L-shaped member sidewall 38A of the housing 34 to undergo vertical slidable movement relative thereto and toward and away from the support rail 12 and means 64 for applying a force on the drive unit 18 so as to bias the drive unit 18 toward the support rail 12 and thereby maintain traction of the drive wheel 54 with the bottom guide track 26 on the support rail 12. The drive unit mounting means 62 includes a plurality of elongated slots 66 defined in the left L-shaped member sidewall 38A of the housing 34 and a plurality of fasteners 68 attached to the gear box 58 of the drive unit 18 and extending through the slots 66 so as to permit movement of the fasteners 68 along and relative to the slots 66 and thereby movement of the drive unit 18 along and relative to the housing 34. The force applying means 64 includes a yieldable flexible spring member 70 coupled between the drive unit 18 and the left L-shaped member sidewall 38A of the housing 34.

By way of example, the motor 56 of the power source 52 can be an electric motor, such as a reversible permanent magnet synchronous instrument grade gear motor which supplies 140 oz.-in. of torque at 6 rpm and has a power consumption of about 5 watts at 120 VAC, roughly 400 milliamps. The motor 56 is slip-fastened by the above-described arrangement of the spring member 70 to the left half of the carrier trolley 14. The spring member 70 is a torsion spring which is looped around a sleeve bearing 72 on the rotary output shaft 60 and the outward legs 70A of the spring member 70 rest upon studs 74 that are fastened to the housing sidewall 38A, thus giving the drive unit 18 an upward movement force equal to that of the spring member 70.

Figure 3:
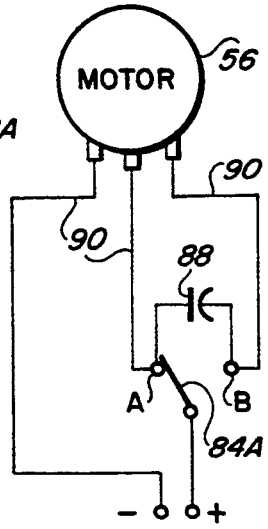
FIG. 3 is a schematic diagram of the electrical circuit for operating the overhead moving system.

Referring to FIGS. 4–8, the actuation unit 16 of the overhead moving system 10 includes first and second stop means 76, 78 mounted in spaced locations along the support rail 12 in opposite directions from the carrier trolley 14, and an actuator box 80 mounted at a base wall 80A thereof on the exterior of the sidewall 36A of the right L-shaped member 36 of the housing 34 on the right lateral side thereof. Thus, the actuator box 80 is mounted to the side of the trolley 14 opposite to the motor 56. The actuation unit 16 also includes an elongated actuating arm 82 and a switch mechanism 84 disposed in the actuator box 80. The actuating arm 82 is mounted through a pair of slots 86 defined respectively in opposite front and rear end walls 80B, 80C of the actuator box 80. The opposite ends 82A of the actuating arm 82 are engagable with the first and second stop means 76, 78 upon the carrier trolley 14 arriving adjacent to the locations thereof along the support rail 12. The switch mechanism 84 is mounted on the base wall 80A of the actuator box 80 below a middle portion of the actuating arm 82. The switch mechanism 84 has an actuating lever 84A which is attached to the middle portion of the actuating arm 82 and is actuatable between first and second contact positions A, B (as seen in FIG. 3) in response to engagement by the opposite ends 82A of the actuating arm 82 with the first and second stop means 76, 78 so as to actuate the drive unit 18 to reverse the direction of operation of the motor 56 and of rotation of the output shaft 60 and drive wheel 54 and thereby move the carrier trolley 14 in opposite directions along the support rail 12. The switch mechanism 84 preferably is a single-pull double-throw limit type microswitch. The switch mechanism 84 also includes a capacitor 88 connected across the contact positions A, B and the switch mechanism is electrically connected to the motor 56 by conductors 90 to provide the necessary circuit for the reversible motor 56 to operate in either clockwise or counterclockwise rotation which, in turn, dictates the direction of travel.

Referring to FIGS. 7 and 8, each of the stop means 76, 78 includes a flexible rectangular-shaped plate 92 having an aperture 94 tapped through the center thereof and a thumb screw 96 threaded therein. The plate 92 is removably wedged between the upper mounting base 20 and lower member 22 of the support rail 12 and is retained thereon by ledges 20A, 22A extending respectively along the upper mounting base 20 and lower member 22. The thumb screws 96 of each stop means 76, 78 extend across and block the path of the actuating arm 82 at the opposite ends of the path of travel of the trolley 14.

Assuming the support rail 12 is mounted to the ceiling C, the overhead moving system 10 operates as follows. With the carrier trolley 14 hung on the support rail 12, the desired object is then hung from hanger 42 at the centered location on the bottom portion of the housing 34. The weight of the object is supported entirely by the pairs of roller wheels 46, 48. The upward force imposed on the drive unit 18, by the torsion spring member 70, causes the drive wheel 54 to contact the bottom guide track 26 on the underside of the lower member 22 of the support rail 12. This provides the necessary traction for movement of the trolley 14. As power is applied to the drive unit 18, the trolley 14 will travel along the support rail 12 in the direction opposite that of the position of the switch actuating arm 82. As the trolley 14 reaches the end of path of travel preset by the user, the switch actuating arm 82 will contact the respective one of the thumb screws 96 of the switch stop means 76, 78, moving the switch actuating arm 82 upon the actuating lever 84A of the switch mechanism 84, thereby changing the flow of current to the motor 56. It is at this time that the direction of rotation of the motor 56 changes, thus creating the opposite direction of travel of the trolley 14. The interaction of the switch actuating arm 82 with the switch stop means 76, 78 thus causes the trolley 14 to go back and forth by itself.

One application for which the overhead moving system 10 has been designed is the movement of supplemental lighting fixtures in greenhouses and indoor grow rooms. The main function of the overhead moving system 10 is to move the light source above the plants at or above two feet per minute so the candlepower of the lights can be more effectively used. The light source can be placed closer to the plant when the light is moving than if it is stationary. The system 10 makes the use of supplemental lighting more cost effective. The system 10 makes it possible to not only expand the number of plants, but it also enables the grower to use more of the candlepower he or she is paying for.

There are many other applications for the overhead moving system 10. The moving system 10 is basically a lightweight, low cost overhead crane. It can be used to move mannequins in store displays or move tools along production lines. It can be used to move lighting fixtures in large warehouses to the area where work is taking place so that all of the lights do not have to be turned on.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. An overhead moving system, comprising:

(a) an elongated support rail attachable to an overhead support structure;

(b) a carrier trolley mounted to said support rail for undergoing movement along said support rail, said carrier trolley including a housing having a pair of opposite lateral sides and rotatable means mounted on an upper portion of said housing for movably supporting said housing from said support rail;

(c) an actuation unit supported on said support rail and said housing on one of said pair of lateral sides thereof;

(d) a drive unit mounted on said housing on the other of said pair of lateral sides thereof, said drive unit being coupled to said actuation unit and engaged with said support rail for drivingly causing movement of said carrier trolley therealong upon actuation of said drive unit by said actuation unit;

(e) means for mounting said drive unit on said housing to undergo slidable movement relative thereto and toward and away from said support rail, said drive unit mounting means including (i) means defining a plurality of elongated slots in said other lateral side of said housing, and (ii) a plurality of fasteners attached to said drive unit and extending through said slots so as to permit movement of said fasteners along and relative to said slots and thereby said drive unit along and relative to said housing; and (f) means for applying a force on said drive unit so as to bias said drive unit toward said support rail and thereby maintain traction of said drive unit with said support rail.

2. The system of claim 1 wherein said support rail includes:

an upper mounting base attachable to an overhead support structure;

a lower member having a pair of top guide tracks and a bottom guide track defined thereon; and a vertical support member extending between said upper base and lower member and being connected along an upper edge to said upper mounting base and along a lower edge to said lower member between said top guide tracks defined thereon.

3. The system of claim 2 wherein each of said pair of top guide tracks has a flat configuration.

4. The system of claim 1 wherein said bottom guide track has a concave cross-sectional configuration.

5. The system of claim 1 wherein said force applying means includes a resiliently yieldably flexible spring member coupled between said other lateral side of said housing and said drive unit.

6. The system of claim 1 wherein said actuation unit includes:

first and second stop means mounted in spaced locations along said support rail in opposite directions from said carrier trolley;

an actuating arm mounted on said one lateral side of said housing and engagable with said first and second stop means; and a switch mechanism mounted on said one lateral side of said housing and being coupled to said actuating arm, said switch mechanism being actuatable between first and second positions so as to actuate said drive unit to move said carrier trolley in opposite directions along said support rail in response to engagement of said actuating arm with said first and second stop means.

7. An overhead moving system, comprising:

(a) an elongated support rail having a pair of top guide tracks and a bottom guide track and being attachable to an overhead support structure;

(b) a carrier trolley mounted for undergoing movement along said support rail, said carrier trolley including a housing having a pair of opposite lateral sides and a pair of front and rear ends, front and rear pairs of roller wheels rotatably mounted to said front and rear ends of an upper portion of said housing and supported upon said top guide tracks of said support rail, and an object hanger attached to a lower portion of said housing, said object hanger being disposed in a substantially centered position on said housing between said front and rear ends thereof and between said front and rear pairs of roller wheels to provide a substantially uniform distribution of the weight of a suspended object over all of said wheels;

(c) means mounted on said housing and engaged with said bottom guide track of said support rail for driving said carrier trolley therealong, said driving means including (i) a rotary power source mounted on said housing between said front and rear ends thereof, and (ii) a drive wheel connected to said rotary power source and engaged with said bottom guide track of said support rail for drivingly causing movement of said carrier trolley therealong upon operation of said rotary power source;

(d) means for mounting said driving means on said housing to undergo slidable movement relative thereto and toward and away from said support rail, said mounting means including (i) means defining a plurality of elongated slots in a lateral side of said housing, and (ii) a plurality of fasteners attached to said driving means and extending through said slots so as to permit movement of said fasteners along and relative to said slots and thereby said driving means along and relative to said housing; and (e) means for applying a force on said driving means so as to bias said driving means toward said support rail and thereby maintain traction of said driving means with said support rail.

8. The system of claim 7 wherein said force applying means includes a resiliently yieldably flexible spring member coupled between said lateral side of said housing and said driving means.

9. An overhead moving system, comprising:

(a) an elongated support rail having a pair of top guide tracks and a bottom guide track and being attachable to an overhead support structure;

(b) a carrier trolley mounted for undergoing movement along said support rail, said carrier trolley including a housing having a pair of opposite lateral sides and a pair of front and rear ends, front and rear pairs of roller wheels rotatably mounted to said front and rear ends of an upper portion of said housing and supported upon said top guide tracks of said support rail, and an object hanger attached to a lower portion of said housing, said object hanger being disposed in a substantially centered position on said housing between said front and rear ends thereof and between said front and rear pairs of roller wheels to provide a substantially uniform distribution of the weight of a suspended object over all of said wheels;

(c) an actuation unit supported on said housing on one of said pair of lateral sides thereof;

(d) a drive unit mounted on said housing on the other of said pair of lateral sides thereof, said drive unit being coupled to the actuation unit and having a rotary power source and a drive wheel coupled with said power source and engaged with said bottom guide track of said support rail for drivingly causing movement of said carrier trolley therealong upon operation of said drive unit by said actuation unit;

(e) means for mounting said drive unit on said housing to undergo slidable movement relative thereto and cause movement of said drive wheel toward and away from said bottom guide track of said support rail, said mounting means including (i) means defining a plurality of elongated slots in said other lateral side of said housing, and (ii) a plurality of fasteners attached to said drive unit and extending through said slots so as to permit movement of said fasteners along and relative to said slots and thereby said drive unit along and relative to said housing; and (f) means for applying a force on said drive unit so as to bias said drive wheel into frictional engagement with said bottom guide track to thereby maintain traction of said drive wheel with said bottom guide track.

10. The system of claim 9 wherein said support rail includes:

an upper mounting base attachable to an overhead support structure;

a lower member having said pair of top guide tracks and said bottom guide track defined thereon; and a vertical support member extending between said upper base and lower member and being connected along an upper edge to said upper mounting base and along a lower edge to said lower member between said top guide tracks defined thereon.

11. The system of claim 10 wherein:

each of said pair of top guide tracks have a flat configuration; and said bottom guide track has a concave cross-sectional configuration.

12. The system of claim 9 wherein said force applying means includes a resiliently yieldably flexible spring member coupled between said other lateral side of said housing and said drive unit.

13. The system of claim 9 wherein said actuation unit includes:

first and second stop means mounted in spaced locations along said support rail in opposite directions from said carrier trolley;

an actuating arm mounted on said one lateral side of said housing and engagable with said first and second stop means; and a switch mechanism mounted on said one lateral side of said housing and being coupled to said actuating arm, said switch mechanism being actuatable between first and second positions so as to actuate said drive unit to move said carrier trolley in opposite directions along said support rail in response to engagement by said actuating arm with said first and second stop means.

* * * * *